US007909310B2

(12) United States Patent
Weiner

(10) Patent No.: US 7,909,310 B2
(45) Date of Patent: Mar. 22, 2011

(54) PORTABLE BARRIER APPARATUS

(76) Inventor: Steven L. Weiner, Alamo, CA (US)

( * ) Notice: Subject to any disclaimer, the term of this patent is extended or adjusted under 35 U.S.C. 154(b) by 20 days.

(21) Appl. No.: 12/291,573

(22) Filed: Nov. 12, 2008

(65) Prior Publication Data

US 2010/0044661 A1 Feb. 25, 2010

Related U.S. Application Data

(60) Provisional application No. 61/003,779, filed on Nov. 19, 2007.

(51) Int. Cl.
*E04H 17/02* (2006.01)

(52) U.S. Cl. ..... 256/45; 256/65.14

(58) Field of Classification Search ..... 256/40, 256/43–45, 65.14; 160/24, 25, 135, 351; 248/156, 508, 519, 545
See application file for complete search history.

(56) References Cited

U.S. PATENT DOCUMENTS

| | | | | |
|---|---|---|---|---|
| 342,922 | A * | 6/1886 | Munn | 256/55 |
| 2,454,348 | A | 11/1948 | Schilling | |
| 4,717,110 | A * | 1/1988 | Fohrman | 248/545 |
| 4,844,420 | A * | 7/1989 | Oster | 256/1 |
| 4,993,719 | A * | 2/1991 | Hernandez | 473/492 |
| 5,029,819 | A * | 7/1991 | Kane | 256/24 |
| 5,117,806 | A * | 6/1992 | Soat | 126/29 |
| 5,230,187 | A * | 7/1993 | Reimann | 52/102 |
| 5,484,137 | A * | 1/1996 | Smith | 256/50 |
| 5,501,429 | A | 3/1996 | Sakuma | |
| 5,660,144 | A * | 8/1997 | Venti | 119/416 |
| 5,695,174 | A * | 12/1997 | Tsai | 256/22 |
| 5,816,946 | A * | 10/1998 | Grossman | 473/451 |
| 5,875,597 | A | 3/1999 | Gingrich et al. | |
| D415,729 | S | 10/1999 | Wells | |
| 6,375,164 | B1 * | 4/2002 | Siegler et al. | 256/1 |
| 6,595,496 | B1 * | 7/2003 | Langlie et al. | 256/1 |
| 6,733,204 | B1 * | 5/2004 | Paniccia | 404/6 |
| 6,776,398 | B1 * | 8/2004 | Tsai | 256/45 |
| 6,807,999 | B1 * | 10/2004 | Bowen et al. | 160/24 |
| 6,830,236 | B2 | 12/2004 | Augusto de Lorenzo | |
| 6,969,050 | B1 | 11/2005 | Loebner | |
| 7,082,981 | B2 * | 8/2006 | Perez, Jr. | 160/24 |
| 7,156,357 | B1 * | 1/2007 | Kocur | 248/519 |
| 7,178,790 | B2 * | 2/2007 | de Lorenzo | 256/59 |
| D572,986 | S * | 7/2008 | Zhu et al. | D8/1 |
| 7,503,550 | B2 * | 3/2009 | Liefke | 256/24 |
| 2002/0063248 | A1 * | 5/2002 | Siegler et al. | 256/37 |
| 2002/0162994 | A1 * | 11/2002 | Langlie et al. | 256/45 |
| 2003/0111657 | A1 * | 6/2003 | Green | 256/45 |
| 2003/0222253 | A1 | 12/2003 | Langlie et al. | |
| 2005/0191107 | A1 | 9/2005 | Christie | |
| 2006/0113514 | A1 | 6/2006 | Prismall | |
| 2006/0284029 | A1 * | 12/2006 | Mayorga | 248/85 |
| 2007/0176158 | A1 * | 8/2007 | Robinson | 256/12.5 |

* cited by examiner

*Primary Examiner* — Joshua T Kennedy
(74) *Attorney, Agent, or Firm* — Thomas R. Lampe

(57) ABSTRACT

Portable barrier apparatus including a reel head supported by a post and including a reel mounted barrier tape. A foot stake is connected to the bottom of the post and can be alternatively positioned in the ground or in a support base. The reel head may be removed from the post and replaced by a reel head with a different reel mounted barrier tape.

4 Claims, 8 Drawing Sheets

PORTABLE BARRIER APPARATUS

This Application is based on and claims the benefit of U.S. Provisional Patent Application No. 61/003,779, filed Nov. 19, 2007.

TECHNICAL FIELD

This invention relates to portable barrier apparatus employed to fence or block off an area.

BACKGROUND OF THE INVENTION

Portable barrier systems including a post or stake for insertion in or placement on the ground or other surface and a reel containing a tape or cord which is selectively extended to block off an area or retract it are generally known. Examples of prior art arrangements of this type are shown in the following Patent documents: U.S. Pat. No. 6,595,496, issued Jul. 22, 2003, U.S. Patent Application Pub. No. US 2003/0222253, pub. Dec. 4, 2003, U.S. Pat. No. 5,484,137, issued Jan. 16, 1996, U.S. Pat. No. 4,844,420, issued Jul. 4, 1989, U.S. Pat. No. 5,875,597, issued Mar. 2, 1999, U.S. Pat. No. 6,375,164, issued Apr. 23, 2002, U.S. Patent Application Pub. US 2006/0113514, pub. Jun. 1, 2006, U.S. Patent Application Pub. US 2005/0191107, pub. Sep. 1, 2005, U.S. Pat. No. 2,454,348, issued Nov. 23, 1948, U.S. Pat. No. 6,830,236, issued Dec. 14, 2004, U.S. Pat. No. 5,501,429, issued Mar. 26, 1996, U.S. Pat. No. 6,969,050, issued Nov. 29, 2005, U.S. Design Pat. No. D415,729, issued Oct. 26, 1999 and UK Patent Application GB 2 376 247, pub. Dec. 11, 2002.

DISCLOSURE OF THE INVENTION

The apparatus of the present invention includes post and reel components as well as other cooperative structural components which add to the versatility and ease of use of the device. The invention disclosed herein is also characterized by its relatively low cost and simplicity as compared to prior art approaches.

The portable barrier apparatus includes a foot stake having a foot stake upper portion and a foot stake lower portion projecting downwardly from said foot stake upper portion, said foot stake lower portion including at least one stake member having a distal end spaced from said foot stake upper portion. The foot stake upper portion has a foot engagement top surface for engagement by the foot of an individual to force the at least one stake member into the ground and a ground engagement bottom surface for engaging the ground to limit downward movement of the foot stake relative to the ground.

A post is connected to the foot stake upper portion and extends upwardly therefrom. A reel head is supported by the post and contains a banner tape in wound condition. The banner tape has a lead end projecting from an opening in the reel head enabling the banner tape to be unwound and pulled from the reel head through the opening.

The reel head is selectively releasably connected to the post and is one of a plurality of reel heads, the banner tape contained in each of the plurality of reel heads displaying a message differing from messages displayed by the barrier tapes of the other of the plurality of reel heads.

The portable barrier apparatus additionally includes a support base positionable on the ground or other surface for releasable connection to the foot stake lower portion to support the foot stake lower portion above the ground or other surface and maintain the post in a stable, substantially upright condition.

Other features, advantages and objects of the present invention will become apparent with reference to the following description and accompanying drawings.

MODES FOR CARRYING OUT THE INVENTION

Figure 1:
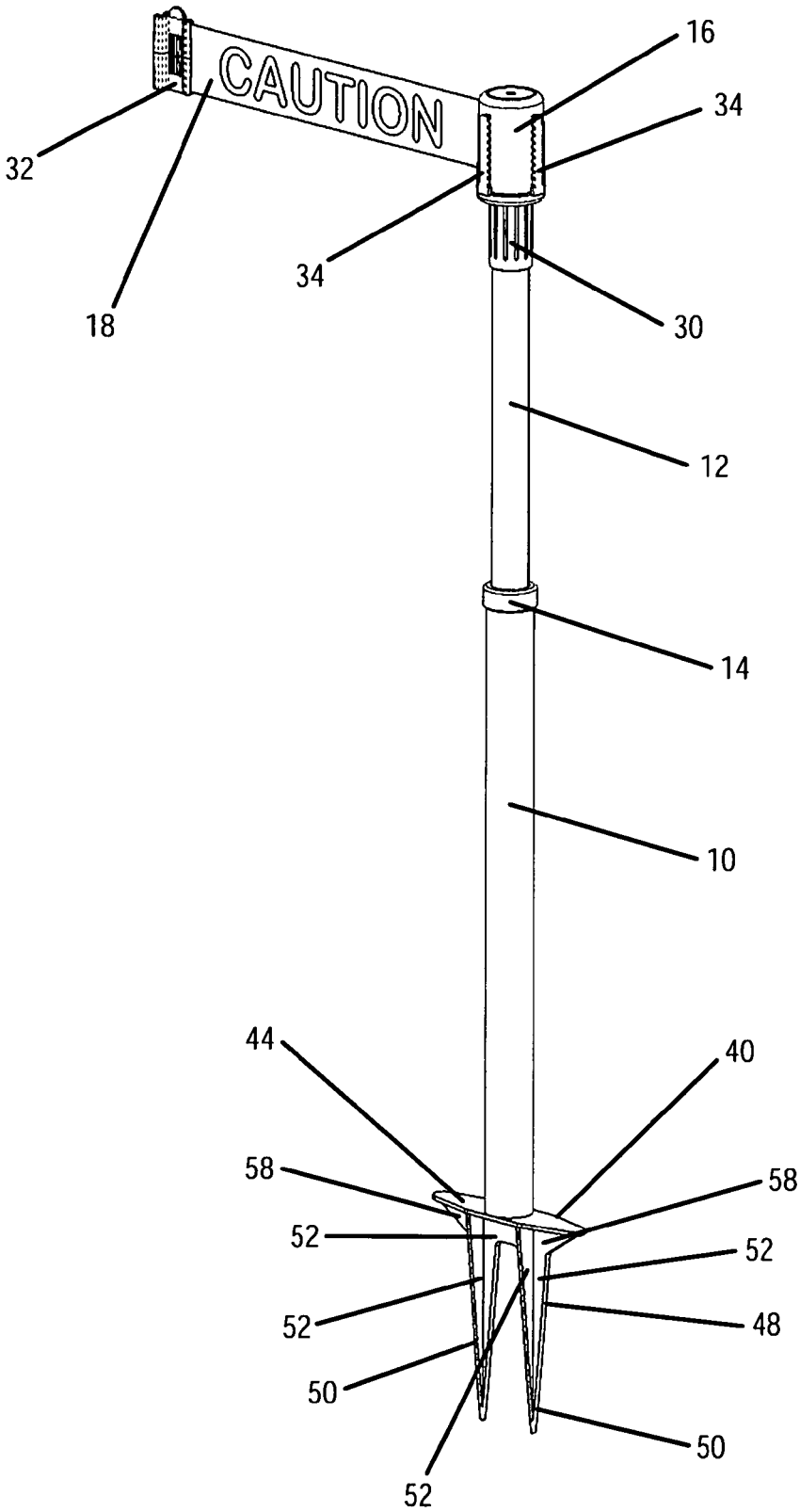
FIG. 1 is a perspective view of assembled structural components of apparatus constructed in accordance with the teachings of the present invention.
Figure 2:
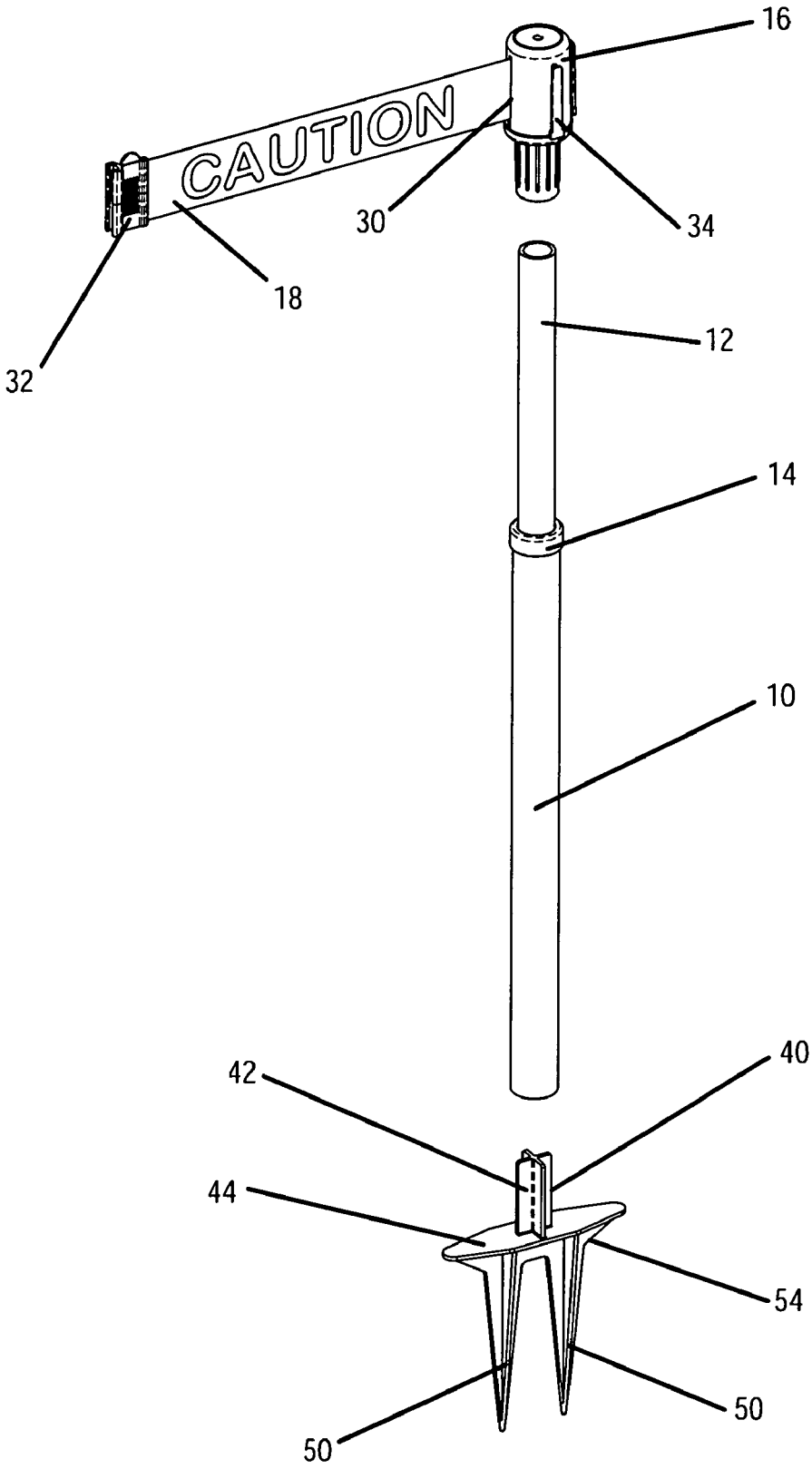
FIG. 2 is a perspective, exploded view illustrating the post, reel head and support base of the apparatus separated.
Figure 3:
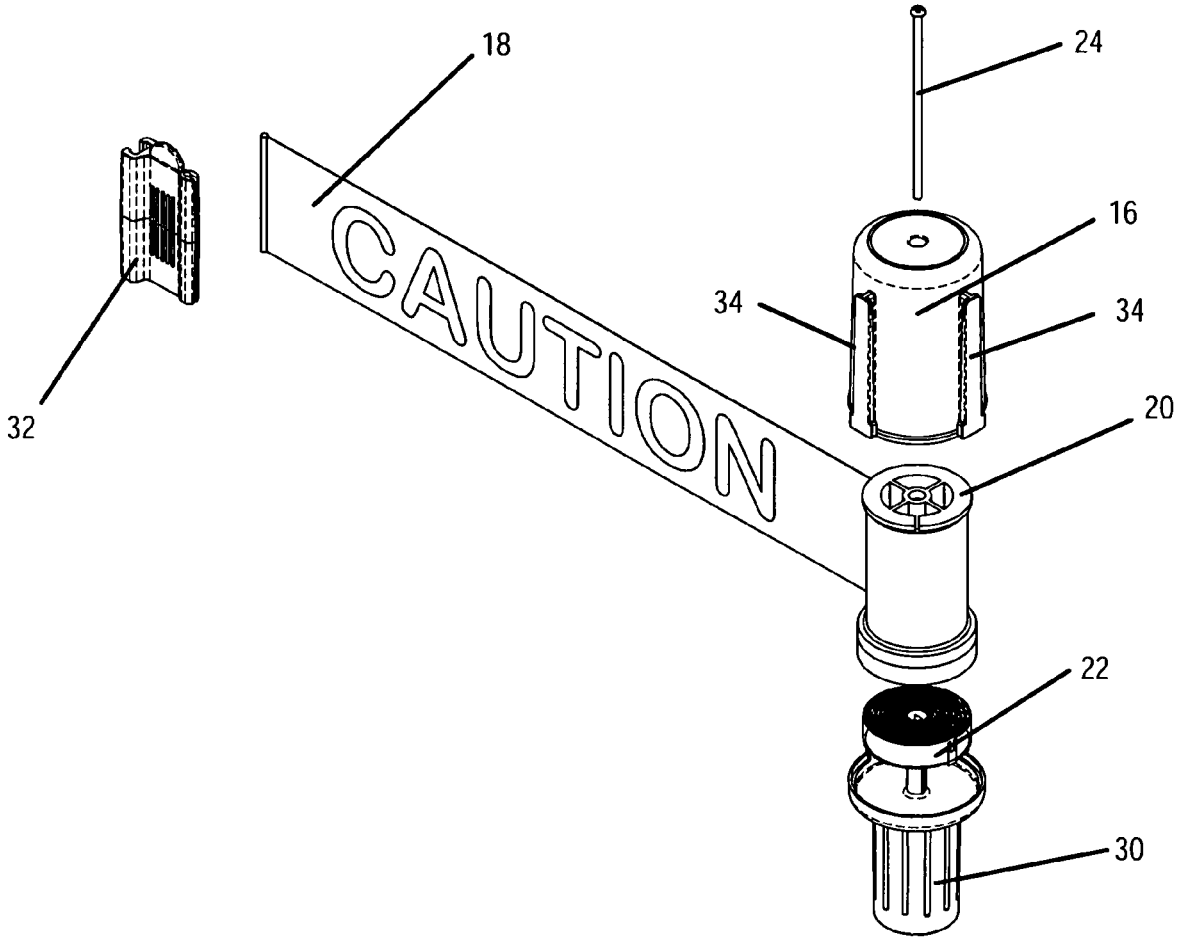
FIG. 3 is an enlarged, perspective, exploded view showing selected components of the apparatus, including a partially extended banner tape and reel head.
Figure 4:
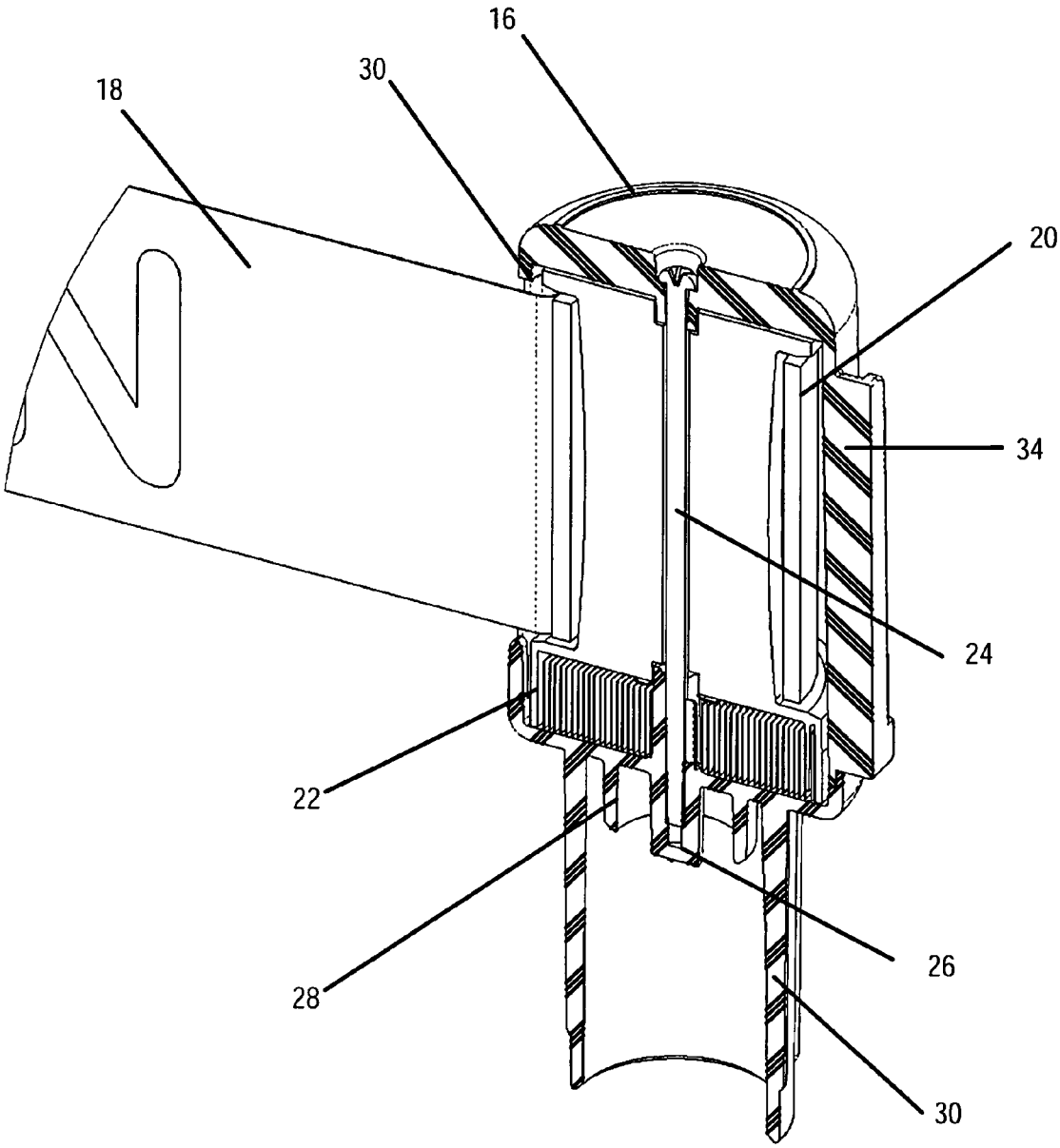
FIG. 4 is an enlarged, perspective cross-sectional view illustrating selected components of the apparatus depicted in FIG. 1 in assembled condition.
Figure 5:
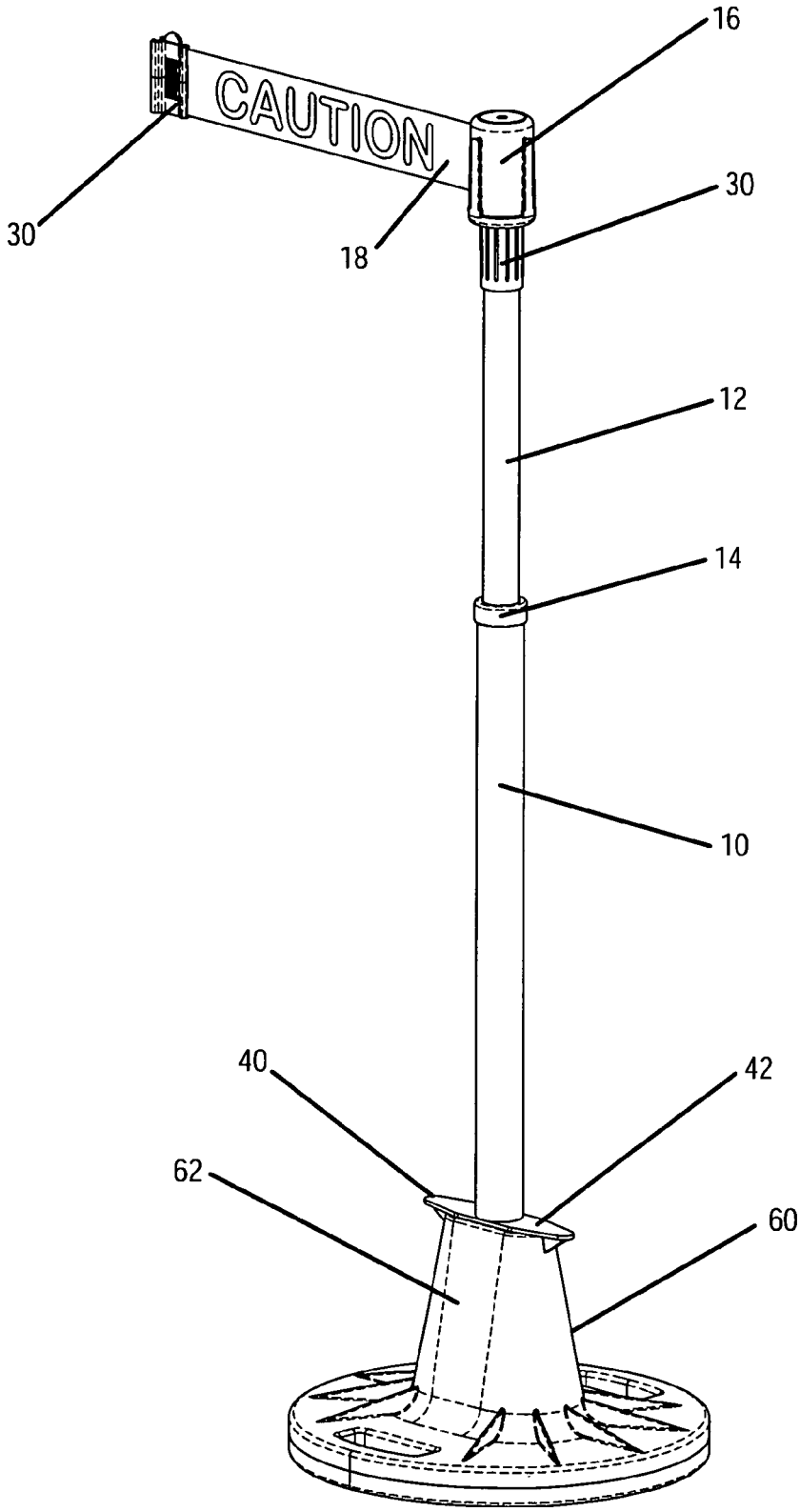
FIG. 5 is a perspective view similar to FIG. 1, but illustrating a support base with the foot stake of the apparatus inserted into a depression formed by the support base.
Figure 6:
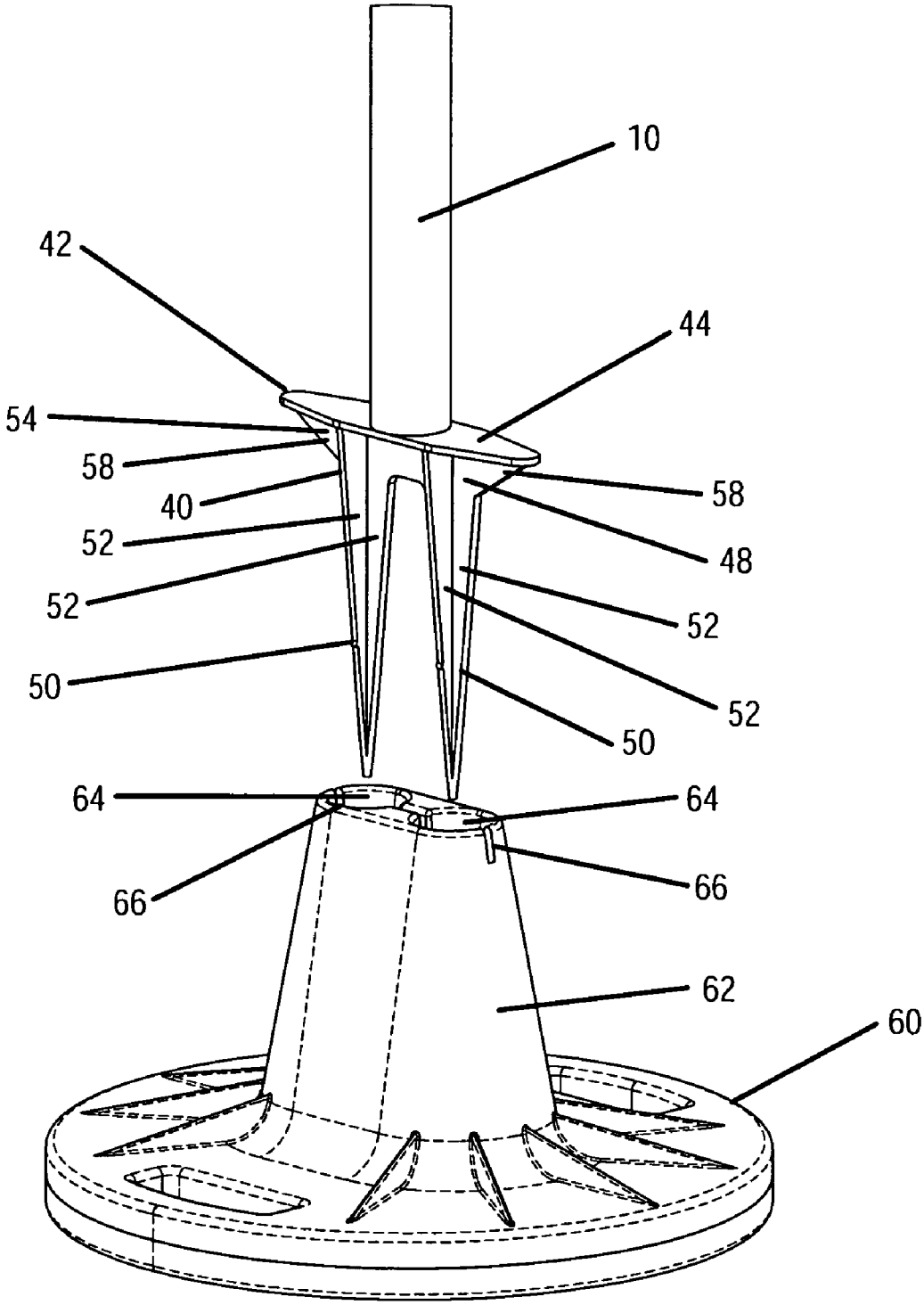
FIG. 6 is an exploded, perspective view illustrating the foot stake of FIG. 5 prior to insertion into the support base.

Referring now to FIGS. 1-6, portable barrier apparatus constructed in accordance with the teachings of the present invention includes a post including a bottom post section 10 and a top post section 12. The bottom post section telescopically receives the top post section.

A friction stop mechanism of any suitable type such as friction grip stop 14 may be utilized to selectively alternatively tighten or loosen the connection between the post sections to provide for height adjustment and selectively maintain the post at a desired length.

Positioned at the upper or distal end of top post section 12 is a tape recoil mechanism in the form of a reel head including a housing 16 which accommodates a barrier tape or banner 18 in wound condition on a rotatable spool or reel 20. Mechanism including a rewind tension spring 22 within the housing continuously biases the reel 20 to maintain the barrier tape in a wound condition; however, the tape may be pulled and extended to a desired length merely by overcoming the spring bias of the rewind structure in the reel head. Such rewind structures per se are well known and need not be described in detail.

In the arrangement illustrated, both the reel head housing 16 and the reel 20 are rotatably mounted on a spindle 24 extending downwardly through the housing 16, through the spool 20, and through the coiled spring 22 into a recess 26 formed by a divider wall 28 at the top of a downwardly extending coupler 30 of the reel head employed to support the reel head and connect the reel head to the top post section 12. The coupler may be loosely fit onto the post and rotatable relative thereto or releasably, rotatably secured thereto in some other manner.

Figure 8:
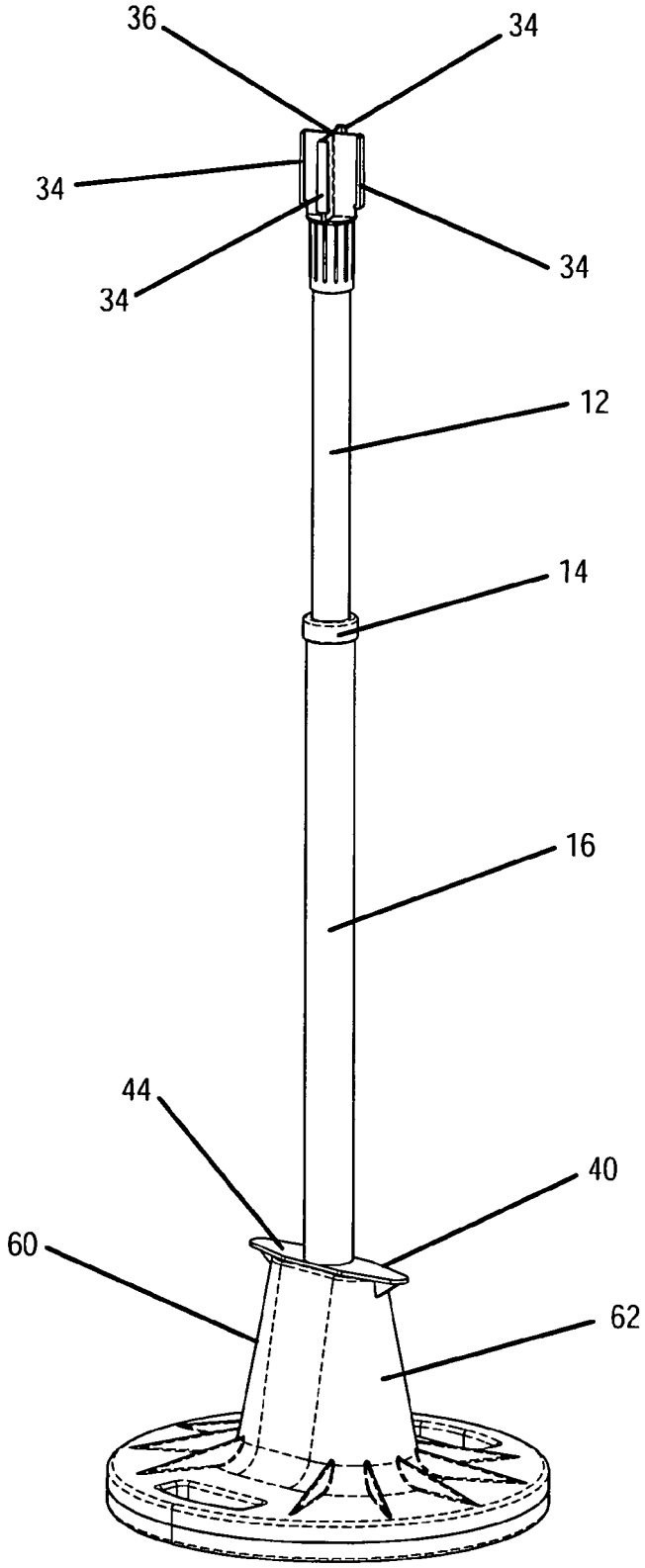
FIG. 8 is a view similar to FIG. 1, but illustrating an alternative form of head disposed on the post.

The housing 16 defines an opening or slot 30 through which the banner tape extends. A connector 32 is attached to the banner tape end which is utilized to secure the tape in extended position when attached to the housing of another reel head or some other structure. In the present instance, housing 16 of the illustrated reel head has three projections 34, any of which can be used to attach the end of a banner tape projecting from another portable barrier apparatus (not shown) of like construction. FIG. 8 shows an alternative head 36 which may be used to establish connection with one or more connectors 32. Head 36 is dedicated to performing such function, having four projections 34, but not accommodating a banner tape.

An important novel aspect of the present invention is the fact that the reel head with barrier tape may be readily removed as a unit from the top post section and replaced with another reel head of like construction and having a tape with a different message suitable for a different use. For example, the illustrated tape displays a "CAUTION" warning. A banner tape of another head may for example have different indicia thereon. For example, rather than a caution warning, the tape may display a phrase such as "Let It Grow" for garden or lawn applications or "Party On" to block off a party area, or a tape may bear no indicia at all. The telescoping height adjustability feature of the post allows adjustment of the height of the displayed tape or banner.

The apparatus includes a foot stake 40 attached to and extending from the lower end of bottom post section 10. An upper portion 42 of the foot stake is inserted into the open lower end of the bottom post section until the bottom post section engages a foot engagement top surface 44 of foot stake upper portion 42 Which projects laterally outwardly as shown.

The foot stake 40 also includes a foot stake lower portion 48 which comprises two downwardly projecting, spaced stake members 50 having pointed distal ends. In the embodiment illustrated, each stake member 50 has four ribs 52 and a generally tapered, cruciform configuration. The stake members 50 project downwardly from a ground engaging bottom surface 54 of the foot stake upper portion 44.

When a user wishes to install the device in the ground, the post is manually oriented vertically and foot pressure is applied to the foot engagement top surface 44 to sink the stake members of the foot stake lower portion into the ground. Ribs 52 provide strength to the foot stake and prevent turning of the foot stake in the ground, thus providing a stable installation. Triangular shaped reinforcement panels 58 extend between ground engaging bottom surface 54 and a rib 52 of each stake member to provide additional strength.

Another structural element of the device is a support base 60 (FIGS. 5, 6 and 8) which allows installation of the post wholly above ground. Base 60 is suitably formed of any suitable material, such as molded plastic or metal. The upper end 62 of the base defines depressions or holes 64 (see FIG. 6) configured in the shape of bottom portion 32. More specifically, each hole 64 conforms to the shape of a stake member 50 with the support base forming the holes frictionally engaging the stake members. In addition, stabilizer slots 66 defined by upper end 62 communicate with the holes and receive reinforcement panels 58 when the stake members are seated in place. The foot stake and post thus are maintained in a stable, upright condition. When the support base is not being used, it can be stored until use is once again desired.

Figure 7:
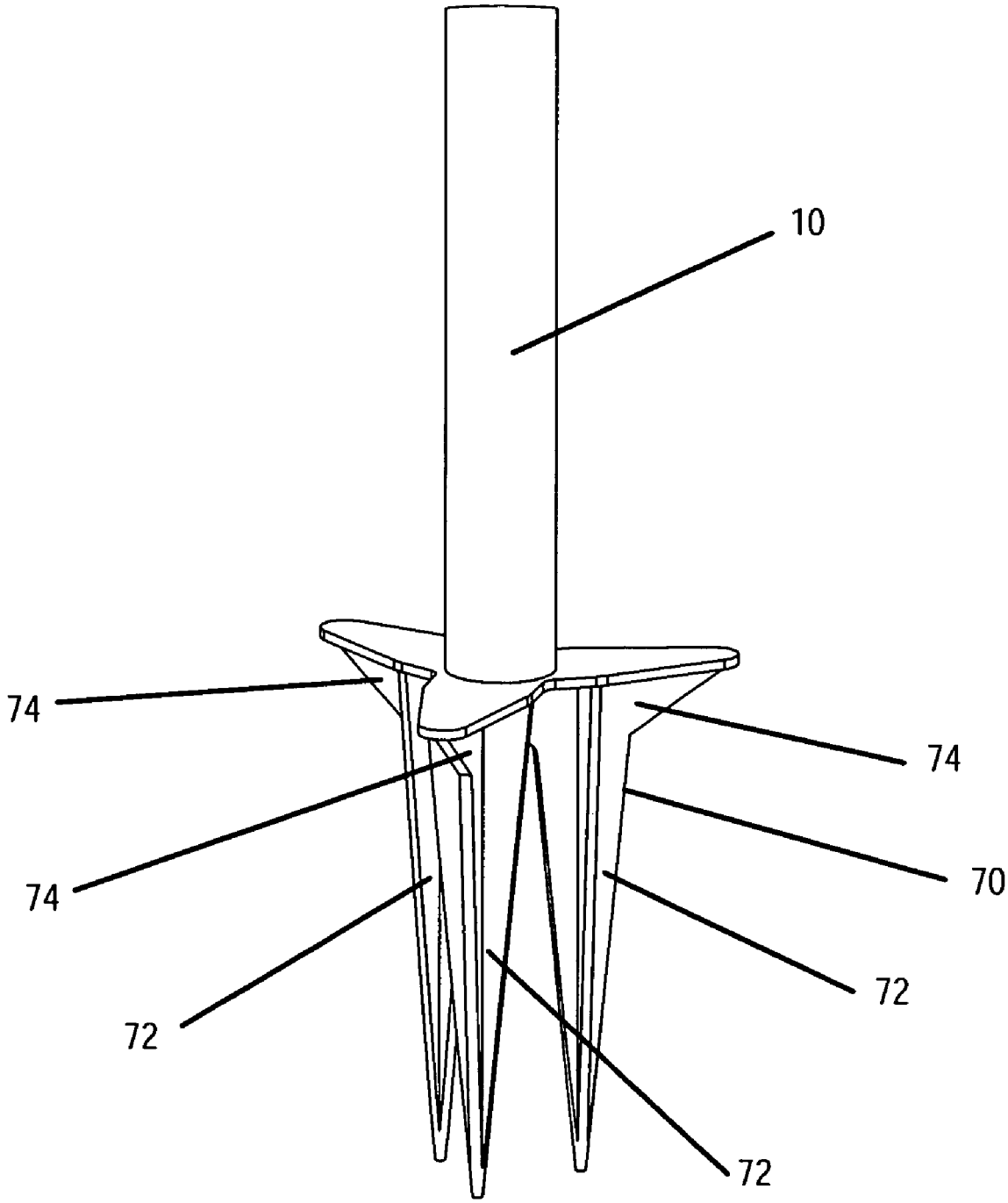
FIG. 7 is an enlarged, perspective view illustrating an alternative form of foot stake.

FIG. 7 shows another embodiment of the invention wherein the foot stake lower portion 70 has three spaced, tapered stake members 72 having distal ends. Also, this embodiment includes three reinforcement panels 74. The support base (not shown) used with this foot stake configuration of course would have three, rather than two, depressions or holes and three stabilizer slots for receiving the stake members.

The invention claimed is:

1. Portable barrier apparatus for blocking off or fencing an area, said portable barrier apparatus comprising, in combination:

a foot stake having a foot stake upper portion and a foot stake lower portion affixed to and projecting downwardly from said foot stake upper portion, said foot stake lower portion including a plurality of elongated stake members spaced from one another, each stake member having a pointed distal end spaced from a proximal end affixed to said foot stake upper portion, and said foot stake upper portion having a foot engagement top surface positioned over said stake members and extending laterally outwardly therefrom for engagement by the foot of an individual to force the stake members into frictional engagement with the ground or a support base and said foot stake upper portion further comprising a ground engagement bottom surface for engaging the ground or support base to limit downward movement of the foot stake relative to the ground or support base and said foot stake lower portion further including reinforcement panels extending from said ground engaging bottom surface to each stake member;

a post connected to said foot stake upper portion and extending upwardly therefrom at a location centrally disposed relative to said stake members;

a reel head supported by said post containing banner tape in wound condition, said banner tape having a lead end projecting from an opening in said reel head enabling said banner tape to be unwound and pulled from said reel head through said opening, said reel head being selectively releasably connected to said post and including a housing defining said opening freely rotatable relative to said post, said reel head being removable and readily interchangeable with other reel heads displaying different messages; and a support base positionable on the ground or other surface for releasable connection to said foot stake lower portion to support said foot stake lower portion above the ground or other surface and maintain said post in a stable, substantially upright condition, said support base defining spaced holes for receiving the stake members, said spaced holes substantially conforming in size and shape to the stake members received thereby such that said stake members are frictionally engaged by said support base along the length thereof to prevent relative movement between said stake members and said support base, said support base additionally defining a stabilizer slot extending thereacross and communicating with said spaced holes for receiving said reinforcement panels to provide additional structural strength and stability when said spaced holes receive the stake members.

2. The portable barrier apparatus according to claim 1 wherein said stake members include ribs extending along the length thereof and have a generally tapered, cruciform configuration.

3. The portable barrier apparatus according to claim 1 wherein said reel head includes a coupler receiving an upper end of said post and releasably connected to said post.

4. Portable barrier apparatus for blocking off or fencing an area, said portable barrier apparatus comprising, in combination:

a foot stake having a foot stake upper portion and a foot stake lower portion affixed to and projecting downwardly from said foot stake upper portion, said foot stake lower portion including at least one elongated stake member having a pointed distal end spaced from a proximal end affixed to said foot stake upper portion, and said foot stake upper portion having a foot engagement top surface elevated relative to said at least one stake member and extending laterally outwardly therefrom for engagement by the foot of an individual to force the at least one stake member into frictional engagement with the ground or a support base and said foot stake upper portion further comprising a ground engagement bottom surface for engaging the ground or support base to limit downward movement of the foot stake relative to the ground or support base and said foot stake lower portion further including at least one reinforcement panel extending from said ground engaging bottom surface to said at least one stake member;

a post connected to said foot stake upper portion and extending upwardly therefrom;

a reel head supported by said post containing banner tape in wound condition, said banner tape having a lead end projecting from an opening in said reel head enabling said banner tape to be unwound and pulled from said reel head through said opening, said reel head being selectively releasably connected to said post and including a housing defining said opening freely rotatable relative to said post, said reel head being removable and readily interchangeable with other reel heads displaying different messages; and a support base positionable on the ground or other surface for releasable connection to said foot stake lower portion to support said foot stake lower portion above the ground or other surface and maintain said post in a stable, substantially upright condition, said support base defining at least one hole for receiving the at least one stake member, said at least one hole substantially conforming in size and shape to the at least one stake member received thereby such that said at least one stake member is frictionally engaged by said support base along the length thereof to prevent relative movement between said at least one stake member and said support base, said support base additionally defining a stabilizer slot and communicating with said at least one hole for receiving said reinforcement panel to provide additional structural strength and stability when said at least one hole receives the at least one stake member.

* * * * *